US010954038B2

(12) United States Patent
Toh et al.

(10) Patent No.: US 10,954,038 B2
(45) Date of Patent: Mar. 23, 2021

(54) CONTAINER AND MANUFACTURE OF A CONTAINER

(71) Applicant: COLGATE-PALMOLIVE COMPANY, New York, NY (US)

(72) Inventors: Kiat-Cheong Toh, Forest Hills, NY (US); Kenneth Reed, III, Edison, NJ (US); Brian Worthington, Dunellen, NJ (US); Francis Tatu, Manlius, NY (US); Willie Werner, Marcellus, NY (US)

(73) Assignee: Colgate-Palmolive Company, New York, NY (US)

( * ) Notice: Subject to any disclaimer, the term of this patent is extended or adjusted under 35 U.S.C. 154(b) by 320 days.

(21) Appl. No.: 15/328,220

(22) PCT Filed: Jul. 22, 2014

(86) PCT No.: PCT/US2014/047662
§ 371 (c)(1),
(2) Date: Jan. 23, 2017

(87) PCT Pub. No.: WO2016/014039
PCT Pub. Date: Jan. 28, 2016

(65) Prior Publication Data

US 2017/0210508 A1 Jul. 27, 2017

(51) Int. Cl.
*B65D 25/28* (2006.01)
*B65D 83/00* (2006.01)
(Continued)

(52) U.S. Cl.
CPC ..... *B65D 25/2805* (2013.01); *A45D 40/04* (2013.01); *B65D 83/0011* (2013.01); *A45D 40/00* (2013.01)

(58) Field of Classification Search
CPC ..... B65D 25/2805; B65D 83/0011; A45D 40/04; A45D 40/00
(Continued)

(56) References Cited

U.S. PATENT DOCUMENTS 4,865,208 A * 9/1989 Lax ..... A47G 23/0241 215/396
4,889,254 A 12/1989 Vola
(Continued)

FOREIGN PATENT DOCUMENTS

DE 202 06 587 7/2002

OTHER PUBLICATIONS

International Search Report and the Written Opinion of the International Searching Authority issued in International Application PCT/US2014/047662 dated Apr. 16, 2015.
(Continued)

*Primary Examiner* — Anthony D Stashick
*Assistant Examiner* — James M Van Buskirk

(57) ABSTRACT

A method of manufacturing a container (1), comprising: providing a body (100) defining a chamber for storing a product and defining an opening through which the product is dispensable from the chamber; selecting a first structure (200) from a plurality of structures, each of the plurality of structures having a feature for forming part of an exterior surface of the container (1) when the respective structure is affixed to the body (100), the feature of the first structure (200) differing from the feature of another structure of the plurality of structures; and affixing to the body (100) the first structure (200) with the feature of the first structure forming part of the exterior surface of the container (1). Also disclosed are a container and a bundle or package of containers.

9 Claims, 3 Drawing Sheets

(51) Int. Cl.
*A45D 40/04* (2006.01)
*A45D 40/00* (2006.01)

(58) Field of Classification Search
USPC ..... 220/775
See application file for complete search history.

(56) References Cited

U.S. PATENT DOCUMENTS

| | | | | |
|---|---|---|---|---|
| 4,950,094 | A | 8/1990 | Yorks | |
| 5,753,212 | A | 5/1998 | Pescatore | |
| 5,967,307 | A | 10/1999 | Wang | |
| 6,269,982 | B1 * | 8/2001 | Kreiseder | A45D 40/04 222/326 |
| 8,267,473 | B2 * | 9/2012 | Flannery | A47D 1/103 297/250.1 |
| 9,510,660 | B2 * | 12/2016 | Ishida | A45D 34/042 |
| 9,795,206 | B2 * | 10/2017 | Ellsworth | A45D 40/04 |
| 2003/0095827 | A1 | 5/2003 | Ruschke et al. | |
| 2009/0044827 | A1 * | 2/2009 | Zilber | A45D 40/00 132/297 |
| 2012/0012551 | A1 | 1/2012 | Sinacori et al. | |
| 2013/0193167 | A1 | 8/2013 | Arora et al. | |
| 2014/0166333 | A1 * | 6/2014 | Porcano | H02G 3/14 174/66 |

OTHER PUBLICATIONS

Adidas, "Deodorant Stick", www.adidasbodycare.com/formen/product/product-listing/deodorant-stick; accessed May 1, 2014.
Colgate-Palmolive, "Gear", www.colgate.com/app/Speedstick/US/EN/HomePage.cvsp; accessed May 1, 2014.

* cited by examiner

CONTAINER AND MANUFACTURE OF A CONTAINER

BACKGROUND

This invention relates to containers, such as dispenser containers, and to their manufacture, such as by injection molding.

It is known to provide containers, such as dispenser containers holding deodorant sticks, with grippable features to facilitate a user's grip of the container. This can be particularly useful when the container is to be used in a wet environment, such as a bathroom or washroom, and/or when the user's hands and/or fingers are wet. Manufacture of such a container by injection molding can be relatively slow due to the complexity of the tooling used in the injection molding process and the cooling time required to manufacture these features. It is necessary to wait for relatively thick material to cool sufficiently before the container can be removed from the mold cavity. Moreover, if a manufacturer wants to change the appearance or grip characteristics of such a container, they have to modify the process by which the container is manufactured. Typically this is a very disruptive and expensive exercise, particularly in cases in which containers are injection molded since the mold for the container needs to be modified.

There is a need for a method of manufacturing a container that permits a manufacturer to change the appearance or grippable feature of a container with reduced disruption, upheaval and cost. There further is a need for a container manufactured according to such a method. There also is a need for a method of manufacturing a container by injection molding that permits faster cooling times of the material from which the container is made.

BRIEF SUMMARY

A first aspect of the invention provides a method of manufacturing a container, comprising:

providing a body defining a chamber for storing a product and defining an opening through which the product is dispensable from the chamber;

selecting a first structure from a plurality of structures, each of the plurality of structures having a feature for forming part of an exterior surface of the container when the respective structure is affixed to the body, the feature of the first structure differing from the feature of another structure of the plurality of structures; and affixing to the body the first structure with the feature of the first structure forming part of the exterior surface of the container.

Optionally, the feature of the first structure forms a grip of the container.

Optionally, the feature comprises a plurality of recesses and/or protrusions; and/or the feature comprises a second material that is more elastic than a material of the body.

Optionally, the feature of the first structure differs from the feature of the other structure in one or both of appearance and tactility.

Optionally, the feature of the first structure differs from the feature of the other structure in one or more of: topography, color, decoration, and material.

Optionally, the chamber extends from a first end of the body towards a second end of the body, wherein the opening is at the first end of the body, and the affixing comprises affixing the first structure to a first side of the body that extends between the first and second ends of the body.

Optionally, the affixing comprises one of adhering and mechanically connecting the first structure to the body.

Optionally, the mechanically connecting comprises mechanically connecting by one or more of a dovetail joint, a snap fit, a friction fit, and one or more clips; further optionally wherein the dovetail joint is a sliding dovetail joint.

Optionally, one of the body and the first structure comprises a projection and the other of the body and the first structure comprises a channel, and the mechanically connecting comprises sliding the projection into the channel.

Optionally, the chamber extends from a first end of the body towards a second end of the body, wherein the opening is at the first end of the body, and the channel is on a first side of the body that extends between the first and second ends of the body.

Optionally, the channel is elongate in a direction that extends from the first end of the body to the second end of the body.

Optionally, the sliding comprises sliding the projection into the channel from one of the first and second ends of the body towards the other of the first and second ends of the body.

Optionally, the mechanically connecting comprises mating one of a tongue and a slot at an elongate end of the first structure with the other of a tongue and a slot of the body.

Optionally, the projection is a tail of a dovetail joint and the channel is a socket of the dovetail joint that is dimensioned to mate with the tail.

Optionally, the affixing comprises affixing the first structure to the body over at least 75% of a length of the first structure; optionally over at least 90% of the length of the first structure.

Optionally, the affixing comprises engaging one or more retaining elements of the first structure with one or more retaining elements of the body to prevent removal of the first structure from the body.

Optionally, wherein the body is made from a body material and the first structure comprises a first material, and the first material is of the same color and/or of the same chemical composition as the body material.

Optionally, the body is made from a body material and the first structure comprises a second material, and the second material is of a different color and/or of a different chemical composition to the body material; further optionally wherein the body material is more rigid than the second material.

Optionally, the chamber extends from a first end of the body towards a second end of the body, wherein the opening is at the first end of the body, and wherein the providing comprises injection molding the body using a straight-pull mold and removing the body from the straight-pull mold in a direction that extends from the first end of the body to the second end of the body.

Optionally, the method comprises injection molding the first structure; further optionally wherein the injection molding the first structure comprises injection molding a first part of the first structure using a first material and injection molding a second part of the first structure using a second material.

Optionally, the second material is of a different color and/or of a different chemical composition to the first material; further optionally wherein the first material is more rigid than the second material.

Optionally, the method comprises affixing to the body a second structure having a feature that forms part of the exterior surface of the container when the second structure is affixed to the body.

Optionally, the method comprises affixing the second structure to the body on a second side of the body that extends between the first and second ends of the body, the second side of the body being a side of the body opposite to the first side of the body.

Optionally, the second structure is identical to the first structure.

Optionally, the method comprises providing the product in the chamber; optionally wherein the providing the product in the chamber is performed after the affixing.

Optionally, the providing the product comprises providing the product in the chamber in fluid form and then allowing the product to solidify.

Optionally, the product is one of a personal care product, an oral care product, and a home care product; further optionally wherein the product is one or more of a deodorant, an antiperspirant, a shaving soap, a soap, a dentifrice, a toothpaste, a mouthwash, a surface cleaner, a laundry detergent, a fabric cleaner, a fabric conditioner, a fabric softener, and a dish washing composition.

Optionally, the method comprises attaching to the body a lid movable relative to the body between a first position at which the lid blocks the opening and a second position at which the opening is not blocked by the lid.

Optionally, the method comprises applying to the body an indication of the product and/or an indication of a source of the product.

Optionally, the method comprises providing the container in a bundle or a package; optionally wherein the bundle or package comprises one or more of a box, a bag, and a shrink wrap.

In a second aspect the invention provides a container, comprising:

a body defining a chamber for storing a product and defining an opening through which the product is dispensable from the chamber; and a first structure affixed to the body over at least 75% of a length of the first structure, the first structure having a feature forming part of an exterior surface of the container.

Optionally, the feature of the first structure forms a grip of the container.

Optionally, the feature comprises a plurality of recesses and/or protrusions; and/or wherein the feature comprises a second material that is more elastic than a material of the body.

Optionally, the chamber extends from a first end of the body towards a second end of the body, wherein the opening is at the first end of the body, and wherein the first structure is affixed to a first side of the body that extends between the first and second ends of the body.

Optionally, the first structure is affixed to the body by one of adhesion and a mechanical connection.

Optionally, the mechanical connection comprises one or more of a dovetail joint, a snap fit, a friction fit, and one or more clips; further optionally wherein the dovetail joint is a sliding dovetail joint.

Optionally, one of the body and the first structure comprises a projection and the other of the body and the first structure comprises a channel, and the mechanical connection comprises the projection located in the channel.

Optionally, the chamber extends from a first end of the body towards a second end of the body, wherein the opening is at the first end of the body, and the channel is on a first side of the body that extends between the first and second ends of the body.

Optionally, the channel is elongate in a direction that extends from the first end of the body to the second end of the body.

Optionally, the mechanical connection comprises one of a tongue and a slot at an elongate end of the first structure mated with the other of a tongue and a slot of the body.

Optionally, the projection is a tail of a dovetail joint and the channel is a socket of the dovetail joint that is dimensioned to mate with the tail.

Optionally, the first structure is affixed to the body over at least 90% of the length of the first structure.

Optionally, one or more retaining elements of the first structure are engaged with one or more retaining elements of the body to prevent removal of the first structure from the body.

Optionally, the body is made from a body material and the first structure comprises a first material, and wherein the first material is of the same color and/or of the same chemical composition as the body material.

Optionally, the body is made from a body material and the first structure comprises a second material, and the second material is of a different color and/or of a different chemical composition to the body material; optionally wherein the body material is more rigid than the second material.

Optionally, a first part of the first structure is made from a first material and a second part of the first structure is made from a second material; further optionally wherein the second material is of a different color and/or of a different chemical composition to the first material; yet further optionally wherein the first material is more rigid than the second material.

Optionally, the container comprises a second structure affixed to the body and having a feature that forms part of the exterior surface of the container.

Optionally, the second structure is affixed to the body on a second side of the body that extends between the first and second ends of the body, the second side of the body being a side of the body opposite to the first side of the body.

Optionally, the second structure is identical to the first structure.

Optionally, the container comprises a lid movable relative to the body between a first position at which the lid blocks the opening and a second position at which the opening is not blocked by the lid.

Optionally, the product is in the chamber; further optionally wherein the product is one of a personal care product, an oral care product, and a home care product; further optionally wherein the product is one or more of a deodorant, an antiperspirant, a shaving soap, a soap, a dentifrice, a toothpaste, a mouthwash, a surface cleaner, a laundry detergent, a fabric cleaner, a fabric conditioner, a fabric softener, and a dish washing composition.

A third aspect of the invention provides a bundle or a package comprising a plurality of containers, each of the containers comprising:

a body defining a chamber for storing a product and defining an opening through which the product is dispensable from the chamber; and a first structure affixed to the body and having a feature forming part of an exterior surface of the container;

wherein the body of a first container of the plurality of containers is identical at least in shape to the body of a second container of the plurality of containers, and the feature of the first structure of the first container differs from the feature of the first structure of the second container.

Optionally, the feature of the first structure forms a grip of the container.

Optionally, the feature comprises a plurality of recesses and/or protrusions; and/or wherein the feature comprises a second material that is more elastic than a material of the body.

Optionally, the feature of the first structure of the first container differs from the feature of the first structure of the second container in one or both of appearance and tactility.

Optionally, the feature of the first structure of the first container differs from the feature of the first structure of the second container in one or more of: topography, color, decoration, and material.

Optionally, the bundle or package comprises one or more of a box, a bag, and a shrink wrap at least partially surrounding the plurality of containers.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

DETAILED DESCRIPTION

The following description of the preferred embodiment(s) is merely exemplary in nature and is in no way intended to limit the invention, its application, or uses.

As used throughout, ranges are used as shorthand for describing each and every value that is within the range. Any value within the range can be selected as the terminus of the range. In addition, all references cited herein are hereby incorporated by referenced in their entireties. In the event of a conflict in a definition in the present disclosure and that of a cited reference, the present disclosure controls.

Figure 5:
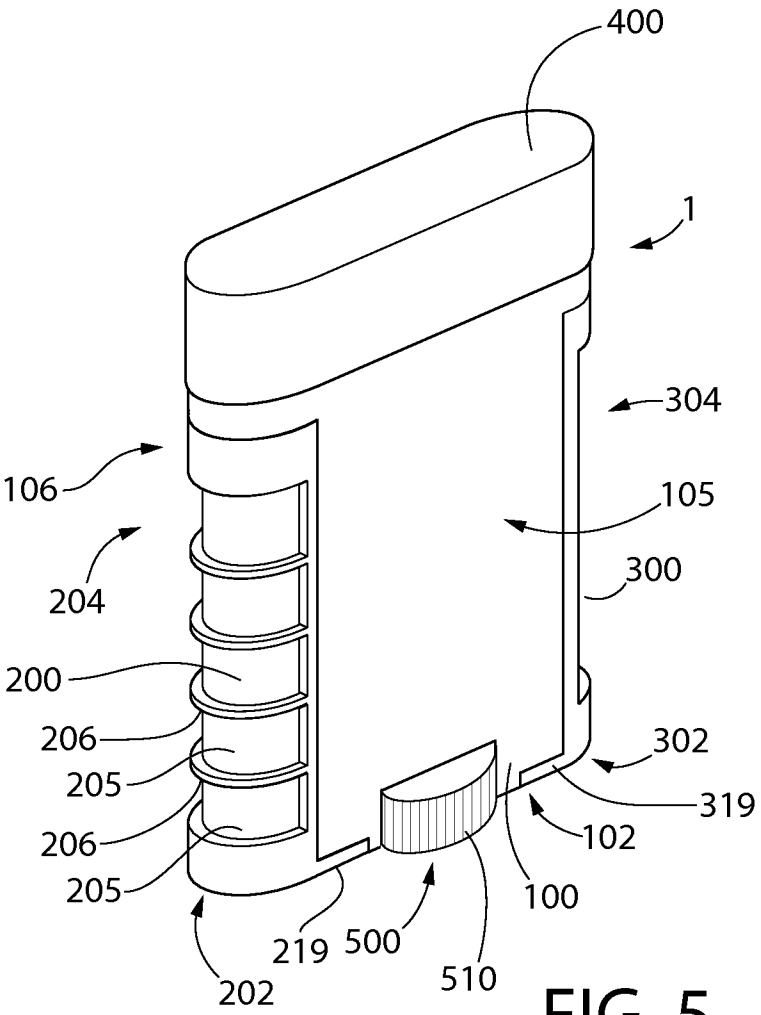
FIG. 5 is a perspective view of a fully assembled container according to an embodiment of the present invention.

FIG. 5 shows a container according to the present invention and indicated by the reference numeral 1. The container 1 comprises a body 100, a first structure 200, a second structure 300, a lid 400, and a dispensing mechanism 500, of which only a thumb wheel 510 is visible in FIG. 5. Each of these components will be described in turn below. Although the container 1 in the illustrated embodiment has the dispensing mechanism 500, and is thus a dispensing container, the present invention also is applicable for the manufacture and provision of non-dispenser containers, i.e. containers lacking a dispensing mechanism. Moreover, although the container 1 in the illustrated embodiment has both the first and second structures 200, 300, in variations to the illustrated embodiment one of the first and second structures 200, 300 may be omitted from the container 1 and the method of manufacturing the container 1 may be suitably amended.

Figure 1:
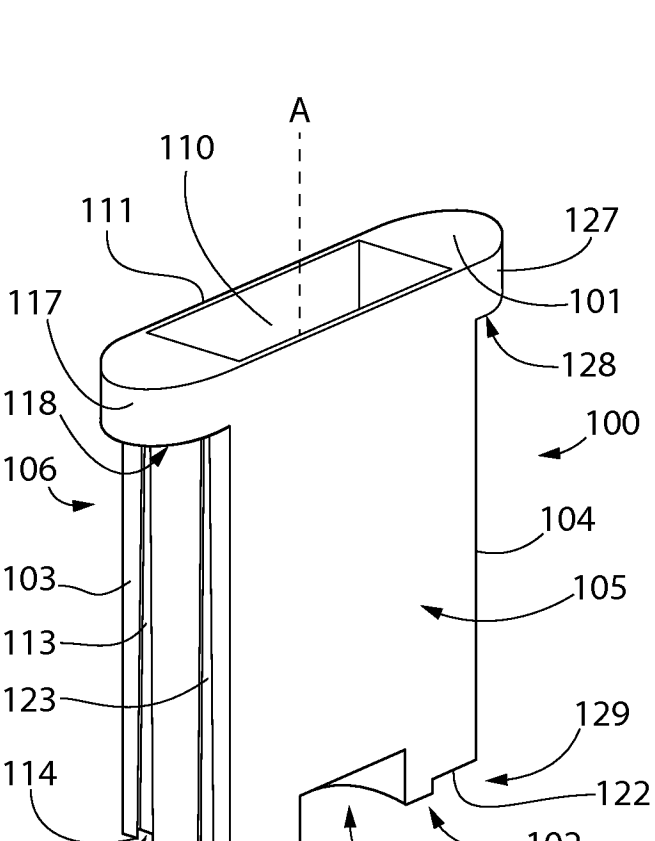
FIG. 1 is a perspective view of a body for a container according to an embodiment of the present invention.

The body 100 is shown in isolation in FIG. 1. The body 100 defines a chamber 110 for storing a product and an opening 111 through which the product is dispensable from the chamber 110. The body has a first end 101, a second end 102, and first to fourth sides 103, 104, 105, 106 that extend between the first and second ends 101, 102 of the body 100. The first and second sides 103, 104 are opposite to each other and are smaller than the third and fourth sides 105, 106. The chamber extends from the first end 101 of the body 100 towards the second end 102 of the body 100 and the opening 111 is at the first end 101 of the body 100.

In the illustrated embodiment, the body 100 is elongate between the first and second ends 101, 102 thereof and defines a longitudinal axis A-A that extends between the first and second ends 101, 102 and passes through the chamber 110 along a middle of the chamber 110. In variations to the illustrated embodiment, the body 100 need not be elongate between the first and second ends 101, 102 and could instead have a length that is substantially the same as, or less than, a width of the body 100 measured between the first and second small sides 103, 104. Also, in the illustrated embodiment, each of the chamber 110 and a majority of the exterior of the body 100 has an oblong cross-sectional shape orthogonal to each of the longitudinal axis A-A and the sides 103, 104, 105, 106. In variations to the illustrated embodiment, the exterior of the body 100 and/or the chamber 110 may have a different cross-sectional shape orthogonal to each of the longitudinal axis A-A and the sides 103, 104, 105, 106, such as square, triangular, polygonal, circular, elliptical, D-shaped or irregular.

The body 100 comprises first and second channels 113, 123 formed in a surface on the first side 103, and third and fourth channels formed in a surface on the second side 104, although only the first and second channels 113, 123 are visible in the Figures. Each of the channels 113, 123 is elongate in a direction that extends from the first end 101 of the body 100 to the second end 102 of the body 100, i.e. parallel to the longitudinal axis A-A. Each of the channels 113, 123 is substantially linear along its full length, which is measured in the direction that extends from the first end 101 of the body 100 to the second end 102 of the body 100, i.e. parallel to the longitudinal axis A-A. Each of the channels 113, 123 is a socket of a sliding dovetail joint, which socket is dimensioned to mate with a respective tail 213, 213 of the first and second structures 200, 300, as will be described below. Accordingly, each of the channels 113, 123 forms a pair of undercuts 114, 115, 124, 125 running along the length of the channel 113, 123 and facing each other across a mouth 116, 126 of the channel 113, 123. Each of the mouths 116, 126 tapers so as to reduce in width with distance from the second end 102 of the body 100. The function of the channel 113, 123 will become apparent from the discussion below.

A first cantilever portion 117 of the body 100 at the first end 101 of the body 100 and on the first side 103 of the body 100 protrudes from the surface in which the first and second channels 113, 123 are formed and in a direction away from the chamber 110 and the longitudinal axis A-A. The first cantilever portion 117 comprises a surface 118 that faces in a direction towards the second end 102 of the body 100 and in which a first slot (not shown) is formed. Similarly, a second cantilever portion 127 of the body 100 at the first end 101 of the body 100 and on the second side 104 of the body 100 protrudes from the surface in which the third and fourth channels are formed and in a direction away from the chamber 110 and the longitudinal axis A-A. The second cantilever portion 127 comprises a surface 128 that faces in a direction towards the second end 102 of the body 100 and in which a second slot (not shown) is formed. The body 100 further comprises a first indent 119 in the area at which the first side 103 meets the second end 102. The first indent 119 extends from the third face 105 to the fourth face 106 of the body 100. A first cavity (not shown) is formed in a surface 112 that partially defines the first indent 119 and faces in a direction towards the second end 102 of the body 100. Similarly, the body 100 comprises a second indent 129 in the area at which the second side 104 meets the second end 102. The second indent 129 extends from the third face 105 to the fourth face 106 of the body 100. A second cavity (not shown) is formed in a surface 122 that partially defines the second indent 129 and faces in a direction towards the second end 102 of the body 100. Each of these slots and cavities is a retaining element of the body 100, the function of which will become apparent from the discussion below.

The body 100 is substantially rigid and is made from a body material that is preferably a plastics material, more preferably a thermoplastic polymer, such as polypropylene (PP), polyethylene terephthalate (PET) or polyethylene terephthalate glycol (PETG). In this embodiment, the body 100 is opaque, but in variations to the illustrated embodiment the body 100 is transparent or translucent to allow a user to view the contents of the chamber 110 from the exterior of the container 1.

At the second end 102 of the body 100, the body 100 comprises a cutout 130 between the first and second sides 103, 104. In the illustrated embodiment, the cutout 130 is midway between the first and second sides 103, 104, but in variations to the illustrated embodiment the cutout 130 could instead be closer to one of the first and second sides 103, 104 than to the other. The cutout 130 extends from the third side 105 to the fourth side 106. Although not visible in the Figures, at the end of the chamber 110 closest to the second end 102 of the body 100, the body 100 comprises a hole that extends from the cutout 130 to the chamber 110. The purpose of the cutout 130 and the hole will also become apparent from the discussion below.

Figure 3:
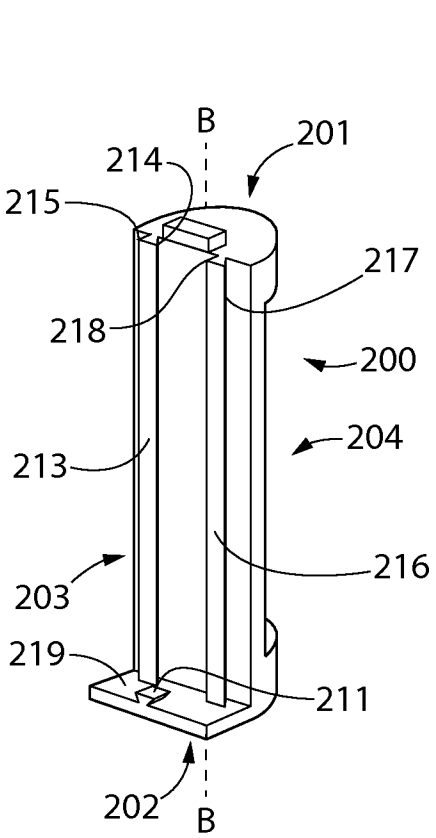
FIG. 3 is a perspective view of an interior side of the first structure.
Figure 2:
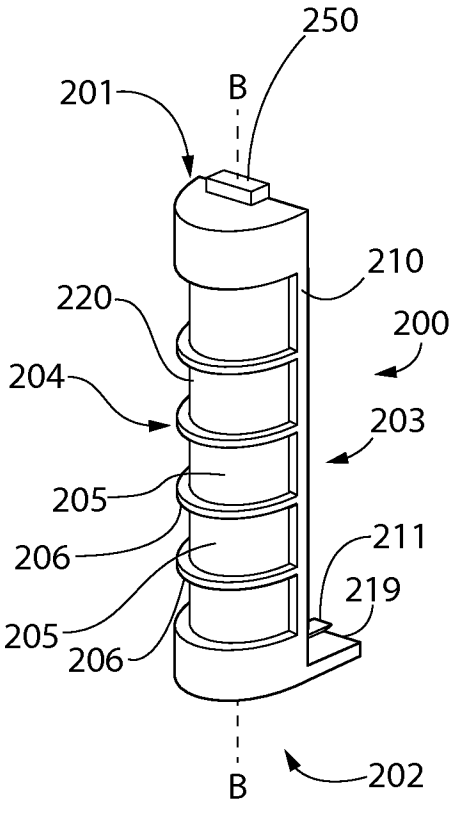
FIG. 2 is a perspective view of an exterior side of a first structure for a container according to an embodiment of the present invention.

The first structure 200 is shown in isolation in each of FIGS. 2 and 3. The first structure 200 has a first end 201, a second end 202, and what are termed interior and exterior sides 203, 204. The exterior side 204 is shown in FIG. 2, and the interior side 203 is shown in FIG. 3. The exterior side 204 of the first structure 200 comprises a feature that forms a grip of the container 1 when fully assembled. The feature comprises a plurality of recesses 205 and protrusions 206, to enable a user to have a good grip of the first structure 200 and, ultimately, the assembled container 1. Once the container 1 is fully assembled with the first structure 200 affixed to the body 100, the feature forms part of an exterior surface of the container 1. In the illustrated embodiment, each of the protrusions 206 comprises a rib or ridge, and each of the recesses 205 comprises a space between adjacent protrusions 206. In variations to the illustrated embodiment, the exterior side 204 of the first structure 200 comprises a feature comprising a plurality of recesses 205 and/or protrusions 206 of different shapes or patterns to those shown. For example, the protrusions 206 may be linear, non-linear, curved, wavy, or columnar. In other variations to the illustrated embodiment, the feature of the first structure 200 forms a grip of the container 1 when fully assembled, but need not comprise a plurality of recesses 205 and protrusions 206. For example, the feature may comprise a second material, such as one of a thermoplastic elastomer (TPE), silicone, and rubber, that is more elastic than a material of the body 100. In some such variations, the feature may form a substantially smooth or textured surface of a part of the exterior surface of the container 1. In still further variations to the illustrated embodiment, the feature of the first structure 200 forms part of an exterior surface of the container 1 but does not form a grip of the container 1 when fully assembled. For example, the feature may be a decorative feature defined by one or more of the topography, color, decoration and material of the feature. The decorative feature may provide visual and/or tactile means for differentiating the container 1 from another container.

In the illustrated embodiment, the first structure 200 is elongate between the first and second ends 201, 202 thereof and defines a longitudinal axis B-B that extends between the first and second ends 201, 202. In variations to the illustrated embodiment, the first structure 200 need not be elongate, or as elongate, between the first and second ends 201, 202. The first structure 200 has a substantially semi-circular cross-sectional shape orthogonal to each of the longitudinal axis B-B and the interior and exterior sides 203, 204. In variations to the illustrated embodiment, the first structure 200 may have a different cross-sectional shape orthogonal to each of the longitudinal axis B-B and the interior and exterior sides 203, 204, such as square, triangular, polygonal, circular, elliptical or irregular.

The first structure 200 comprises first and second projections 213, 216 on the interior side 203. The first and second projections 213, 216 are parallel to each other. Each of the first and second projections 213, 216 extends from the first end 201 to the second end 202 of the first structure 200, i.e. over 100% of the length of the first structure 200, and is elongate in a direction that extends from the first end 201 of the first structure 200 to the second end 202 of the first structure 200, i.e. parallel to the longitudinal axis B-B. Moreover, the first projection 213 is linear along its full length, which is measured in the direction that extends from the first end 201 of the first structure 200 to the second end 202 of the first structure 200, i.e. parallel to the longitudinal axis B-B. Each of the first and second projections 213, 216 is the tail of the sliding dovetail joint mentioned above. The first projection 213 is dimensioned to mate with the second channel 123 of the body 100, and the second projection 216 is dimensioned to mate with the first channel 113 of the body 100, as will be described below. Accordingly, the first projection 213 comprises a pair of undercuts 214, 215 running along the length of the first projection 213 and facing away from each other, and the second projection 216 comprises a pair of undercuts 217, 218 running along the length of the second projection 216 and facing away from each other.

The first structure 200 further comprises a tongue 250 protruding from the first end 201, the tongue 250 being dimensioned to mate with the first slot (not shown) formed in the surface 118 comprised in the first cantilever portion 117 of the body 100. The first structure 200 further comprises a first ledge 219 in the area at which the interior side 203 meets the second end 202. The first ledge 219 extends across a full width of the interior side 203 of the first structure 200. The first structure 200 comprises a resilient tab 211 protruding from the first ledge 219 in a direction towards the first end 201 of the first structure 200. Each of the tongue 250 and the resilient tab 211 is a retaining element of the first structure 200, the function of which will become apparent from the discussion below.

A first part 210 of the first structure 200, comprising the interior side 203 and upper, lower and elongate edge portions of the exterior side 204, is substantially rigid and is made from a first material. The first material may be less, more, or equally as rigid as the body material of the body 100. The first material may be of a different color and/or chemical composition to the body material. The first material may be of the same color and/or chemical composition as the body material. The first material preferably is a plastics material, more preferably a thermoplastic polymer, such as polypropylene (PP), polyethylene terephthalate (PET) or polyethylene terephthalate glycol (PETG). The first part 210 of the first structure 200 defines a recess in the exterior side 204. A second part 220 of the first structure 200 is located in this recess and is made from a second material that is less rigid than the first material of the first part 210 of the first structure 200 and less rigid than the body material. In variations to the illustrated embodiment, the second material is as rigid as the first material of the first part 210 of the first structure 200 and/or as rigid as the body material. In embodiments of the present invention, the second material may be of a different color and/or chemical composition to the first material. In embodiments of the present invention, the second material may be of the same color and/or chemical composition as the first material. In embodiments of the present invention, the second material may be of a different color and/or chemical composition to the body material. In embodiments of the present invention, the second material may be of the same color and/or chemical composition as the body material. The second material optionally is resilient or elastomeric, and may be one of a thermoplastic elastomer (TPE), silicone, and rubber. In the illustrated embodiment, each of the first and second parts 210, 220 of the first structure 200 is opaque so that the first structure 200 is opaque, but in variations to the illustrated embodiment one or both of the first and second parts 210, 220 of the first structure 200 may be transparent or translucent. In some embodiments the first structure 200 is transparent or translucent. In some embodiments, the first structure 200 consists of only one part and is all made from one material, which may be any of the materials mentioned above for the first and second materials.

The second structure 300 is identical to the first structure 200, which provides manufacturing efficiencies. Components of the second structure 300 are shown in the Figures with the same reference numerals as like components of the first structure 200, but with the first number of the numeral being a 3 rather than a 2. In variations to the illustrated embodiment, the second structure 300 is identical to the first structure 200 except that it is a mirror image thereof about a plane parallel to the interior side 203 of the first structure 200. In other variations to the illustrated embodiment, the second structure 300 has a different appearance and/or shape and/or color to the first structure 200. No further discussion of the structure of the second structure 300 will be provided in the interests of conciseness.

The body 100 preferably is formed by injection molding the body material in a mold cavity. Preferably, as is the case in the illustrated embodiment, the body 100 is injection molded using a straight-pull mold. Since the body 100 does not itself comprise the features and material of the first and second structures 200, 300, after molding the body 100 may be removable from the mold cavity in a direction that extends from the first end 101 of the body 100 to the second end 102 of the body 100. That is, once the mold cavity has been opened at the second end 102 of the body 100, the body 100 has no features that prevent withdrawal of the body 100 from the mold cavity. This is advantageous, since more bodies 100 can be molded in a mold tool than in a comparative scenario in which the same sized mold tool is utilized for molding bodies 100 that are unitary with portions comprising the features and material of the first and second structures 200, 300. Moreover, as compared to a scenario in which a split cavity mold is used to mold the body 100, with a join of the two mold halves lying in a plane that passes through the first and second sides 103, 104 of the body 100 substantially parallel to the third and fourth sides 105, 106 of the body 100, it is avoided that flashing needs to be removed from the first and second sides 103, 104 of the body 100 post-molding. This could significantly increase manufacturing throughput and leads to a cleaner, smarter looking container 1.

Each of the first and second structures 200, 300 preferably is formed by injection molding the structure 200, 300 in a mold cavity. For example, the injection molding may comprise injection molding the first part of the first structure 200 using the first material, and then injection molding the second part of the first structure 200 using the second material so as to over-mold the second material onto the first part of the first structure 200. Injection molding each of the first and second structures 200, 300 may comprise bi-injection molding the structure 200, 300 using the first and second materials.

The first structure 200 is affixed to the first side 103 of the body 100 by mechanically connecting the first and second projections 213, 216 with the second and first channels 123, 113, respectively. More specifically, the mechanically connecting comprises inserting the first projection 213 into the second channel 123, and the second projection 216 into the first channel 113, at the second end 102 of the body 100 and sliding the first and second projection 213, 216 in the second and first channels 123, 113, respectively, towards the first end 101 of the body 100. As mentioned above, each of the first and second projections 213, 216 is a tail of a sliding dovetail joint, and each of the second and first channels 123, 113 is a socket of the sliding dovetail joint that is dimensioned to mate with the respective tail. Accordingly, respective elongate edge portions of the first projection 213 slide along and in the undercuts 124, 125 formed by the second channel 123, and the respective elongate "lips" forming therebetween the mouth 126 of the second channel 123 slide along and in the undercuts 214, 215 comprised in the first projection 213. Similarly, respective elongate edge portions of the second projection 216 slide along and in the undercuts 114, 115 formed by the first channel 113, and the respective elongate "lips" forming therebetween the mouth 116 of the first channel 113 slide along and in the undercuts 217, 218 comprised in the second projection 216. During this movement of the first structure 200 relative to the body 100, due to the tapering nature of the mouths 116, 126 of the first and second channel 113, 123, the fit between the first structure 200 and the body 100 becomes increasingly tight and robust. Moreover, after during this movement of the first structure 200 relative to the body 100, the tongue 250 of the first structure 200 becomes mated with the first slot (not shown) formed in the surface 118 comprised in the first cantilever portion 117 of the body 100. Similarly, the resilient tab 211 protruding from the first ledge 219 of the first structure 200 becomes engaged with, in this embodiment snaps into, the first cavity (not shown) formed in the surface 112 that partially defines the first indent 119 of the body 100. In this state, and in the illustrated embodiment at least, the second end 102 of the body 100 and the second end 202 of the first structure 200 are aligned. Moreover, the feature comprising the plurality of recesses 205 and protrusions 206 of the first structure 200 form part of an exterior surface of the container 1.

The mating of the tongue 250 with the first slot, the resilient tab 211 with the first cavity, and the tails of the sliding dovetail joints with the sockets of the sliding dovetail joint, prevents further movement of the first structure 200 relative to the body 100. In other words, the first structure 200 is prevented from being removed from the body 100, at least without destruction of, or substantial damage to, one or both of the first structure 200 and the body 100. Since the first structure 200 is affixed to the body 100 over the full length of the first structure 200, a user is not able inadvertently to separate the first structure 200 from the body 100. In variations to the illustrated embodiment, the tongue 250 and/or the first slot and/or the resilient tab 211 and/or the first cavity can be omitted.

In variations to the illustrated embodiment, the first projection 213 and the second projection 216 might not extend along the full length of the first structure 200, so that the first structure 200 is not affixed to the body 100 over the full length of the first structure 200. However, it is preferred that the first structure 200 be affixed to the body 100 over at least 75% of the length of the first structure 200, and more preferably over at least 90% of the length of the first structure 200, in order to provide a robust container 1.

Figure 4:
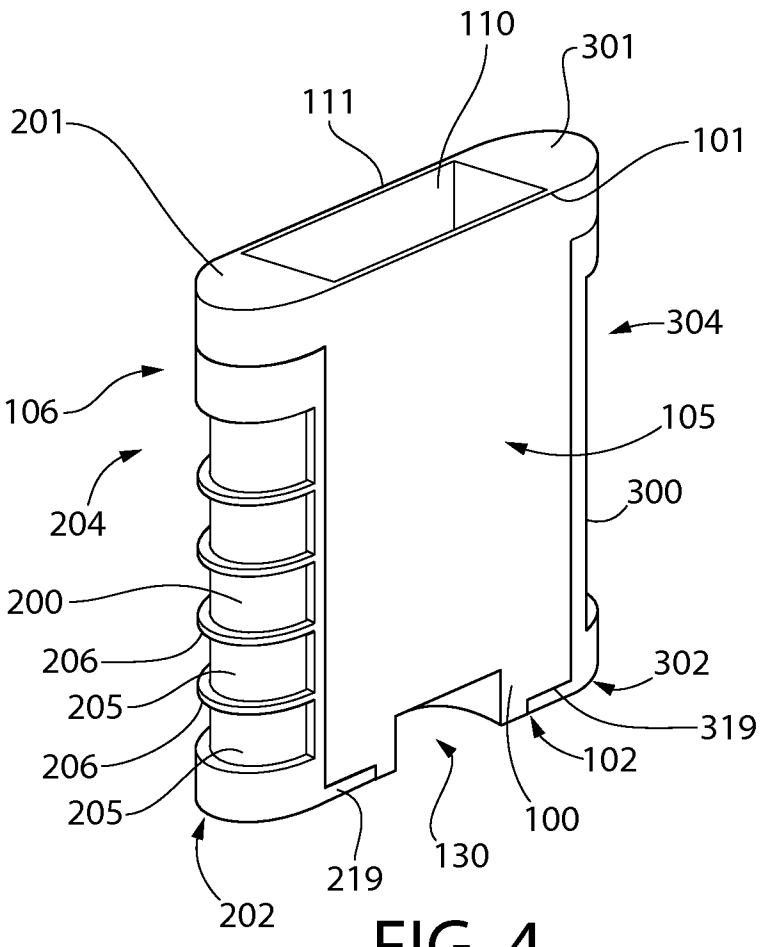
FIG. 4 is a perspective view of a part assembled container according to an embodiment of the present invention.

The second structure 300 is affixed to the second side 104 of the body 100 by mechanically connecting the projections of the second structure 300 with the third and fourth channels formed in a surface on the second side 104 of the body 100, in the same way as discussed above for the affixing of the first structure 200 to the first side 103 of the body 100, so that a feature of the second structure 300 forms part of an exterior surface of the partly-assembled container 1, as shown in FIG. 4.

In other embodiments of the present invention, the first and second structures 200, 300 may be affixed to the body 100 by a mechanical connection of a different form to that illustrated, such as one or more of a dovetail joint, a snap fit, a friction fit, and one or more clips. In further embodiments of the present invention, the first and second structures 200, 300 may be affixed to the body 100 by a non-mechanical connection, such as by adhesion. Herein "adhesion" and "adhering" are intended to encompass both the use of a distinct adhesive and welding, such as sonic welding. In any event, it is preferred that the first and second structures 200, 300 be affixed to the body 100 over at least 75% of the length of each of the first and second structures 200, 300, and more preferably over at least 90% of the length of each of the first and second structures 200, 300, in order to provide a robust container 1.

Preferably after the first and second structures 200, 300 have been affixed to the body 100, a product support platform (not shown) of the dispensing mechanism 500 is inserted into the chamber 110. The product support platform preferably is of the same cross-sectional shape as the chamber 110, and is dimensioned to permit longitudinal movement of the product support platform within the chamber 110 in the direction of the longitudinal axis A-A of the body 100 and to prevent rotational movement of the product support platform within the chamber 110 about the longitudinal axis A-A. The product support platform has a circular hole therein that extends from a first product support side of the platform facing the first end 101 of the body 100 to a second side of the platform facing the second end 102 of the body 100. A wall of the circular hole of the platform comprises a female screw thread. A shaft (not shown) of an actuator of the dispensing mechanism 500 is then inserted into the chamber 110 via the hole that extends from the cutout 130 to the chamber 110. During this insertion the shaft is rotated to engage a male screw thread of the shaft with the female screw thread of the platform, and one or more nubs extending radially from the shaft pass through the hole and are compressed by a wall of the hole. The actuator also comprises the thumb wheel 510 operably connected to the shaft. When the shaft of the actuator is fully inserted, the nub(s) are located within the chamber 110 and prevent removal of the shaft from the chamber 110 through the hole, and the thumb wheel 510 is located in the cutout 130. The thumb wheel 510 is thereafter rotatable relative to the body 100 to rotate the shaft relative to the platform, thereby to drive the platform in a direction away from the second end 102 of the body 100 and towards the first end 101 of the body 100.

After the dispensing mechanism 500 has been so connected to the body 100, the lid 400 is detachably attached to the first end 101 of the body 100, preferably by one of a friction fit and a snap fit. The lid 400 is movable relative to the body 100 between a first position, as shown in FIG. 5, at which the lid 400 blocks the opening 111, and a second position (not shown), at which the opening 111 is not blocked by the lid 400. In variations to the illustrated embodiment, and when the shape and dimensions of the lid 400 and body 100 are suitable, the lid 400 may be detachably attached to the first end 101 of the body 100 by a threaded connection.

Next, the product to be supplied in the container 1 to a consumer is provided in the chamber 110. The product preferably is a personal care product, such as any one or more of a deodorant, an antiperspirant, and a shaving soap, but alternatively the product may be an oral care product or a home care product. The product is introduced into the chamber 110 in fluid form via a passage in the thumb wheel 510 that extends from an interior of the thumb wheel 510 to the chamber 110 via the hole that extends from the cutout 130 to the chamber 110. After entering the chamber 110, the fluid product passes through one or more holes formed in the platform, so as to come into contact with the first product support side of the platform. Once a sufficient volume of the product has been so introduced, the product is then allowed to solidify within the chamber 110 and becomes adhered to the first product support side of the platform. A plug is inserted into the passage in the thumb wheel 510 so as to block the passage. The plug may be retained in the passage by an adhesive or by a mechanical connection. In variations to this embodiment, the product may be provided in the chamber 110 before the first and/or second structures are affixed to the body 100.

Before, during or after providing of the product in the chamber 110, indication(s) of the product and/or its source is applied to the body 100. Preferably, this comprises adhering to one or both of the third and fourth sides 105, 106 of the body 100 one or more labels including the indication(s). The indication(s) may comprise any one or more of a brand name, a manufacturer name, a manufacturer's contact details, an intended purpose of the product, and ingredients of the product.

It will be noted that, in the final container 1, the features of the first and second structures 200, 300, which features in the illustrated embodiment comprise the plurality of recesses 205 and protrusions 206, form part of an exterior surface of the container 1.

In embodiments of the present invention, since each of the first and second structures 200, 300 is formed or otherwise provided separately from the body 100, containers having different appearances may be provided relatively cheaply and easily, by combining different structures 200, 300 with a common body 100. Thus, in preferred embodiments of the method of the present invention, prior to affixing the structure(s) 200, 300 to the body 100, the structure(s) 200, 300 may be selected from a plurality of structures, each of the plurality of structures having a feature for forming part of an exterior surface of the container when the respective structure is affixed to the body, the feature of the first structure 200 differing from the feature of another structure of the plurality of structures, and the feature of the second structure 300 differing from the feature of another structure of the plurality of structures. The feature of the first structure 200 may differ from the feature of the other structure in one or both of appearance and tactility. The feature of the first structure 200 may differ from the feature of the other structure in one or more of: topography, color, decoration, and material.

Figure 6:
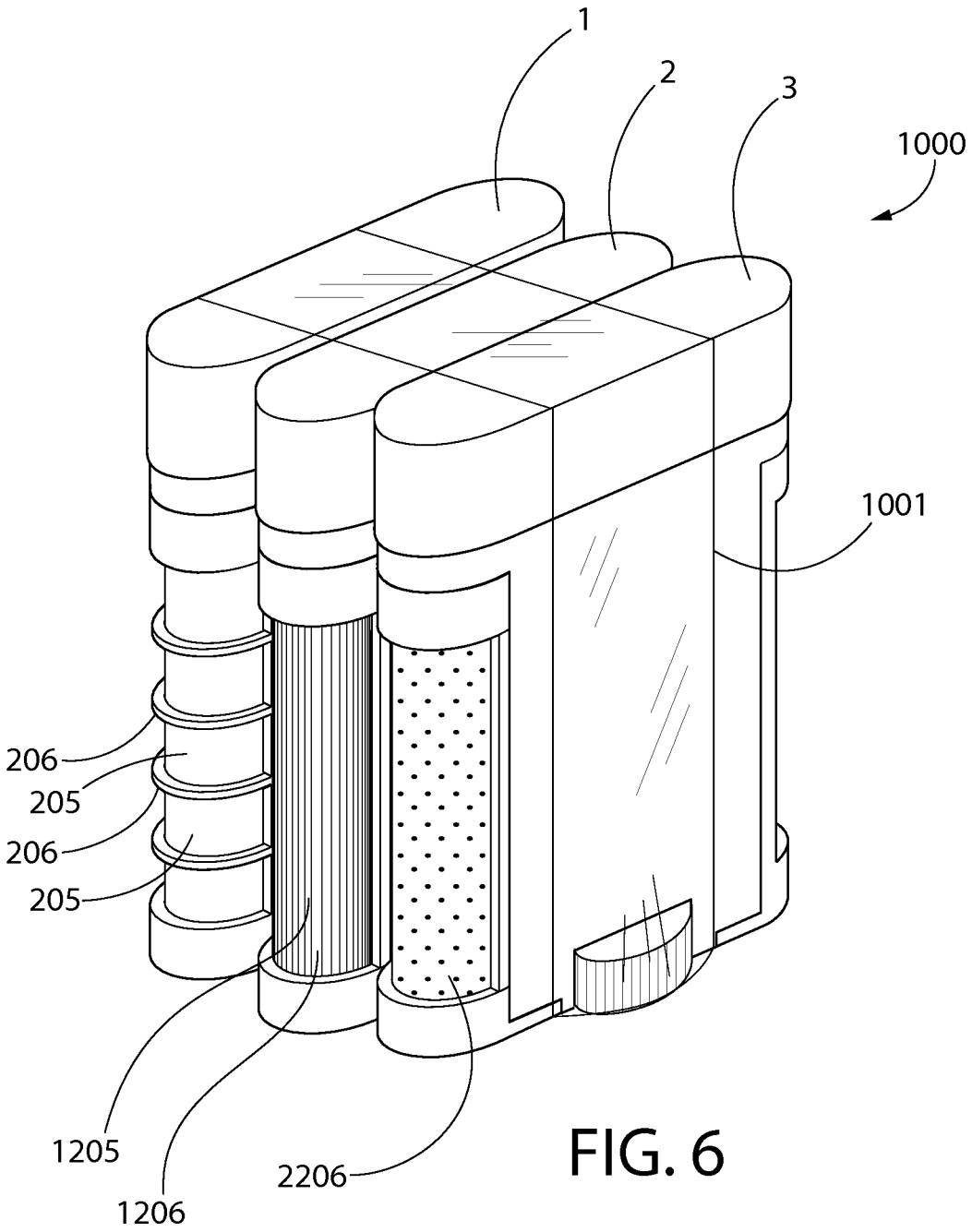
FIG. 6 is a perspective view of bundle or package of containers according to an embodiment of the present invention.

Optionally, the container 1 may be provided in a package, such as one or more of a box, a bag, and a shrink wrap. Optionally, the container 1 may be provided in a bundle or package 1000 with other containers 2, 3, as shown in FIG. 6. Each of the plurality of containers 1, 2, 3 has an identical body 100. That is the body of a first container 1 of the plurality of containers 1, 2, 3 is identical at least in shape to the body of a second container 2 of the plurality of containers 1, 2, 3. However, the first structure of the first container 1 of the plurality of containers 1, 2, 3 has a feature that differs from a feature of the first structure of the second container 2 of the plurality of containers 1, 2, 3, so that, overall, the second container 2 differs from the first container 1. The feature of the first structure of the first container 1 may differ from the feature of the first structure of the second container 2 in one or both of appearance and tactility. The feature of the first structure of the first container 1 may differ from the feature of the first structure of the second container 2 in one or more of: topography, color, decoration, and material. The bundle or package 1000 comprises a shrink wrap 1001 at least partially surrounding the plurality of containers 1, 2, 3 to hold the plurality of containers 1, 2, 3 together until it is desired to use one of the containers 1, 2, 3 or to sell one of the containers 1, 2, 3 in isolation.

If a manufacture wants to change the appearance or grip characteristics of future containers 1, they need only modify the process by which the first and second structure(s) 200, 300 are provided. They need not alter the process by which the body 100 is provided, which thus avoids considerable expense, upheaval and disruption. Moreover, since the first and second structure(s) 200, 300 are provided separately from the body 100, the first and second structure(s) 200, 300 and the body 100 can each be manufactured using a process that results in the first and second structure(s) 200, 300 and the body 100 having smaller wall thicknesses. For example, the first and second structure(s) 200, 300 can be substantially hollow. In embodiments in which the first and second structure(s) 200, 300 are manufactured by injection molding, this permits faster cooling times of the material from which the first and second structure(s) 200, 300, and thus the container 1 as a whole, is made, and thus enables the components from which the container 1 is made to be removed from a mold cavity quickly.

In the illustrated embodiment, since the first and second structures 200, 300 do not define the chamber 110, the first and second structures 200, 300 are not in direct contact with the product stored in the chamber 110 in the assembled container 1, which permits the use of materials for the manufacture of the first and second structures 200, 300 that could be incompatible with the product.

It should be noted that although the illustrated embodiments incorporate a specific dispensing mechanism in the form of a thumb wheel 510 located in a cutout 130, other embodiments of the container may not incorporate such a dispensing mechanism. In particular, when the container is intended, adapted or configured to dispense a solid stick product, such as a deodorant and/or antiperspirant stick, any suitable stick dispensing mechanism known to those skilled in the art may be incorporated into the container.

What is claimed is:

1. A method of manufacturing a container, comprising:

providing a body defining a chamber for storing a product and defining an opening through which the product is dispensable from the chamber, wherein the chamber extends from a first end of the body towards a second end of the body, wherein the opening is at the first end of the body;

selecting a first structure from a plurality of structures, each of the plurality of structures having a feature for forming part of an exterior surface of the container when the respective structure is affixed to the body, the feature of the first structure differing from the feature of a second structure of the plurality of structures;

affixing to a first side of the body the first structure with the feature of the first structure forming a grip of the container, wherein the first side of the body extends between the first and second ends of the body; and affixing to a second side of the body the second structure with the feature of the second structure forming another grip of the container, wherein the second side of the body extends between the first and second ends of the body, and wherein the first side is formed opposite the second side.

2. The method of claim 1, wherein the feature comprises a plurality of recesses and/or protrusions; and wherein the feature comprises a second material that is more elastic than a material of the body.

3. The method of claim 1, wherein the affixing comprises one of adhering and mechanically connecting the first structure to the body.

4. The method of claim 3, wherein the first structure comprises a projection and the body comprises a channel, and the mechanically connecting comprises sliding the projection into the channel.

5. The method of claim 4, wherein the channel is on the first side of the body that extends between the first and second ends of the body.

6. The method of claim 4, wherein the projection is a tail of a dovetail joint and the channel is a socket of the dovetail joint that is dimensioned to mate with the tail.

7. The method of claim 1, wherein the providing comprises injection molding the body using a straight-pull mold and removing the body from the straight-pull mold in a direction that extends from the first end of the body to the second end of the body.

8. The method of claim 1, comprising providing the product in the chamber; wherein the providing of the product in the chamber is performed after the affixing, and wherein the product is one of a personal care product, an oral care product, and a home care product.

9. A container made according to the method of claim 1.

* * * * *